United States Patent [19]

Kiriake

[11] Patent Number: 4,613,091

[45] Date of Patent: Sep. 23, 1986

[54] COP TRANSPORTING SYSTEM FOR AN AUTOMATIC WINDER

[75] Inventor: Masaharu Kiriake, Kyoto, Japan

[73] Assignee: Murata Kikai Kabushiki Kaisha, Kyoto, Japan

[21] Appl. No.: 473,704

[22] Filed: Mar. 9, 1983

[30] Foreign Application Priority Data

Mar. 13, 1982 [JP] Japan ..... 57-40025

[51] Int. Cl.[4] ..... B65H 67/02; B65H 67/06

[52] U.S. Cl. ..... 242/35.5 A

[58] Field of Search ..... 242/35.5 A, 35.5 R, 242/35.6 R

[56] References Cited

U.S. PATENT DOCUMENTS

| | | | |
|---|---|---|---|
| 3,154,904 | 11/1964 | Furst | 242/35.5 R X |
| 3,195,298 | 7/1965 | Furst | 242/35.5 R X |
| 3,358,940 | 12/1967 | Beckwith, Jr. et al. | 242/35.5 A |
| 3,474,975 | 10/1969 | Brouwer et al. | 242/35.5 R |

*Primary Examiner*—Stanley N. Gilreath

*Attorney, Agent, or Firm*—Spensley Horn Jubas & Lubitz

[57] ABSTRACT

A cop supplying system for an automatic winder in which a plurality of cops from which yarns are to be unwound by winding units are always held in full stock conditions in stand-by positions of the winding units. New cops are successively carried into cop stand-by positions by way of a cop transporting passage and surplus cops are recirculated from a last one to a first one of the winding units by way of a surplus cop recirculating passage.

5 Claims, 5 Drawing Figures

COP TRANSPORTING SYSTEM FOR AN AUTOMATIC WINDER

BACKGROUND OF THE INVENTION

The present invention relates to a cop supplying system for an automatic winder.

In an automatic winder of the type which includes a number of winding units disposed in a row, supply of cops to each winding unit is normally carried out to a magazine attached to each winding unit with a travelling truck or by a hand of a man and so on. Conventionally, in response to a cop demanding instruction issued from the magazine of a winding unit, either the travelling truck stops at a position adjacent the winding unit to throw new cops into the magazine of the winding unit or the travelling truck throws new cops into the magazine while it is travelling, or alternatively, an operator picks up new cops from a cop box held by him and throws them into a magazine of a winding unit.

In such cases, it is necessary to provide each winding unit with a detecting device for detecting that cops have been used up. Also, there is the possibility that cops be not thrown into an empty magazine in error if the empty magazine is not held in position when cops are to be thrown in by the travelling truck. Besides, a considerable time is required from the issuance of a cop demanding instruction to the arrival of an operator or the travelling truck. These conditions provide a certain limit to the speed and reliability of supply of cops.

SUMMARY OF THE INVENTION

An object of the present invention is to provide a cop transporting system in which a plurality of cops from which yarns are to be unwound by winding units are always held in full stock conditions in stand-by positions of the winding units for supply thereof in order to eliminate the necessity for a transporting truck or for a hand of a man and so on. To this end, the cop transporting system is constituted such that new cops are successively carried into cop stand-by positions of the winding units by way of a cop transporting passage; those winding units which are in full stock conditions with the cop stand-by positions thereof filled with cops do not take in new cops coming thereto and allow them to pass thereby while those winding units which are not in full stock conditions receive new cops until their full stock conditions are reached; and when all of the winding units are in the full stock conditions, surplus cops are recirculated from a last one to a first one of the winding units by way of a surplus cop recirculating passage which is provided in addition and in contiguous relationship to the cop transporting passage and which extends from the last one to the first one of the winding units.

DETAILED DESCRIPTION OF THE INVENTION

A preferred embodiment of the present invention will be described in detail.

Figure 1:
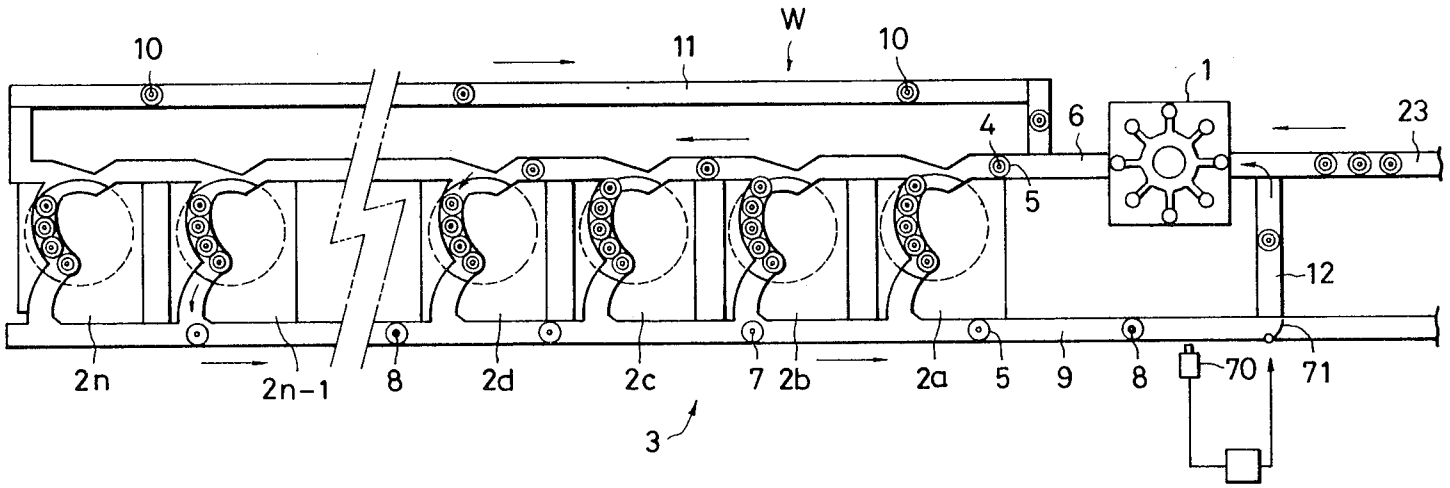
FIGS. 1 and 2 are each a schematic plan view of an automatic winder including a cop yarn leading device and a winding apparatus.
Figure 2:
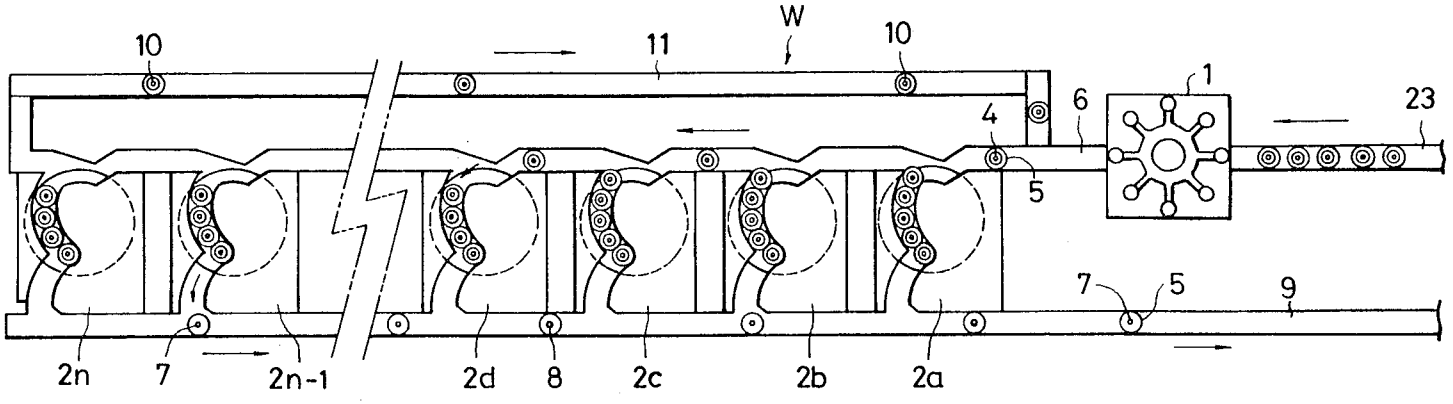

FIGS. 1 and 2 each illustrate a substantial plan view of an automatic winder to which a cop transporting system of the present invention is applied. The automatic winder, generally designated by W, includes a yarn end readying device 1, a winding apparatus 3 having a plurality of winding units 2*a*, 2*b*, . . . 2*n* disposed in a row, a cop transporting passage 6 for transporting trays 5 having cops 4 fitted thereon from the end readying device 1 to any of the winding units 2*a* to 2*n* therealong, a returning passage 9 for feeding back to a spinning machine (not shown) or to the end readying device 1 empty bobbins 7 from which yarns have been unwound by the winding apparatus 3 or disunwindable cops 8 having a yarn left thereon which cannot be unwound therefrom, and a recirculating passage 11 extending between the last winding unit 2*n* and the first winding unit 2*a* for feeding surplus cops 10 which have been caused to appear at the last winding unit 2*n* back to a portion of the cop transporting passage 6 just before the first winding unit 2*a*. The winder W may further include a circuit 12 for disunwindable cops where required.

In the followings, individual components of the winder will be described in detail. At first, description will be given of the cop yarn end readying device 1 with reference to FIG. 3.

The cop yarn end readying device 1 includes a cop hanger device 13 which has a plurality of cop hanging arms 15 extending radially from an intermittently rotating shaft 14 and a cop gripper 16 provided at an end of each of the cop hanging arms 15. The cop gripper 16 has a pair of fingers 17 depending therefrom and urged in a direction for engagement with each other at their respective ends. The cop gripper 16 further has a dish-formed member 18 mounted thereon for engagement with the opposite top ends of the fingers 17 such that, if the dish-formed member 18 is depressed against the urging of a spring not shown, the fingers 17 are pushed down thereby and open the lower ends thereof. Further, a pulley 19 is mounted above the dish-formed member 18 such that rotation thereof will rotate the fingers 17 about a common axis. Rocking plates 20*a* and 20*b* for pushing down the dish-formed member 18 are supported on shafts 21*a* and 21*b*, respectively, which are connected to rods 22*a* and 22*b*, respectively, so that, if the rod 22*a* or 22*b* is axially moved up and down, the associated rocking plate 20*a* or 20*b* is rocked by the shaft 21*a* or 21*b*. Each of the rocking plates 20*a*, 20*b* has an end disposed for engagement with a dish-formed member 18 such that rocking motion thereof will push down the dish-formed member 18 to push down to open the associated fingers 17. Since the cop hanger device 13 has up to eight cop hanging arms 15, the intermittently rotating shaft 14 is designed to rotate by an angle of 45 degrees at a time. Below the cop hanger device 13, there is provided a conveyor 24 in contiguous relationship to a cop transporting passage 23 which transports cops 4 uprightly fitted on trays 5 from an apparatus not shown which uprightly loads cops after fine spinning onto trays 5. A stopper member 25 is provided for stopping a cop 4 at a position below a cop gripper 16 which is currently positioned at a cop chucking position A of the cop hanger device 13, and another stopper member 26 is disposed upstream of the stopper member 25. It is to be noted that, while a cop 4 is being fed, it is held uprightly fitted or mounted on a tray 5 which has a peg 28 erected at the center of a disk 27. A yarn trailing end sucking pipe 30 is disposed at a position B below and spaced by an angle of 45 degrees of rotation from the cop chucking position A. The yarn trailing end sucking pipe 30 is mounted for up and down movement, and when it is moved to a raised position, it surrounds a cop 4B supported by the cop hanger device 13. A conduit 31 is connected to the bottom end of the yarn trailing end sucking pipe 30. The conduit 31 is also connected to a filter box 32 which is in turn connected to a suction device not shown by means of a duct 33. Below a position C after movement of the cop gripper 16 by an angle of 90 degrees of rotation of the cop hanger device 13 from the cop chucking position A, a bobbin supporting rod 34 is disposed for up and down movement and also for rotational movement. When the bobbin supporting rod 34 is moved to a raised position, it is inserted into a hole formed at a lower portion of a bobbin and cooperates with the cop gripper 16 to support the bobbin at opposite bottom and top ends thereof. Further, a beater 37 is provided which includes an unright rotary shaft 35 extending in parallel relationship with the bobbin supporting rod 34 and a plurality of blades 36 mounted around the upright rotary shaft 35. The beater 37 is disposed such that an end of one of the blades 36 thereof is slightly contacted with a surface of a layer of a yarn on a cop 4C gripped by and depending from the cop gripper 16. A yarn end sucking device 39 is also disposed adjacent the surface of the yarn layer of the cop 4C and has a suction opening 38 extending in a direction along the length of the cop 4C. The yarn end sucking device 39 is also connected to the duct 33 via the filter box 32. In addition, below a position D of the cop gripper 16 after rotation of an angle of 135 degrees from the new cop chucking position A, a yarn end sucking pipe 40 is provided which is mounted for movement toward and away from a bobbin in its axial direction. The yarn end sucking pipe 40 is connected to the suction duct 33 via the filter box 32 so that, when it is positioned adjacent the lower end of the bobbin, the end of the yarn can be sucked into the bobbin from an opening formed at the top end of the bobbin. Also, below a position E of the cop gripper 16 after rotation of an angle of 180 degrees from the new cop chucking position A, a stopper 41 is provided for momentarily stopping a tray 5 which has been fed thereto on the conveyor 24. Between the yarn trailing end sucking pipe 30 and the cop supporting rod 34, a cutter 42 is provided for cutting the yarn end sucked in the yarn trailing end sucking pipe 30. A yarn guide 43 is also provided which engages with and draws up yarn which extends between the yarn end suction opening 38 and the cop 4*d* at the position after rotation of an angle of 135 degrees from the cop chucking position A. When the yarn guide 43 is raised, the yarn is arrested by a feeler 44. Another cutter 45 is also provided which cuts the yarn between the yarn guide 43 and the feeler 44.

Figure 4:
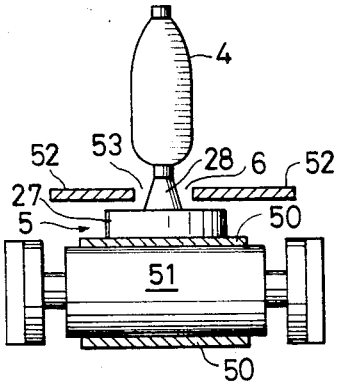
FIG. 4 is a sectional view of a cop transporting passage.
Figure 5:
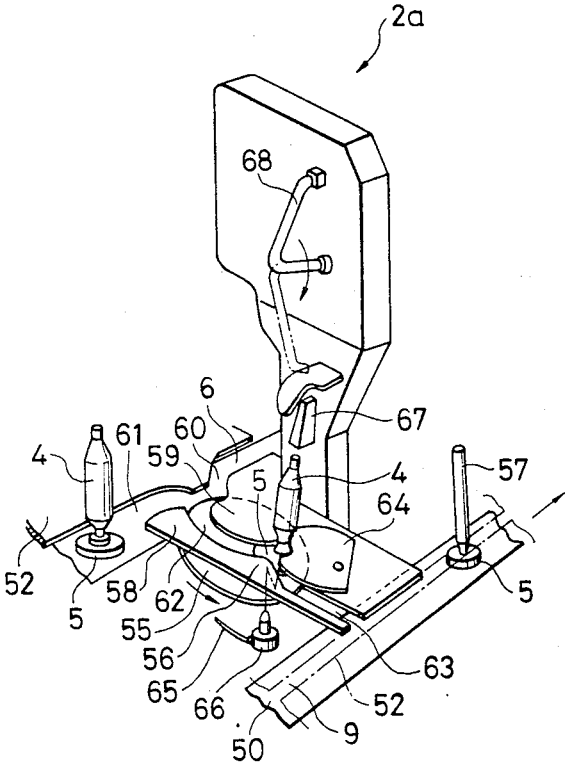
FIG. 5 is a perspective view of a winding unit.

Since the cop transporting passages 6 and 23 and the returning passage 9 have a similar construction, description will be given only of the cop transporting passages. FIG. 4 illustrates the cop transporting passage in section.

A belt conveyor 50 is disposed in front of and extends over the substantially whole length of a machine frame of the winder W and is supported on a suitable number of rollers 51. A pair of guide plates 52 are supported above the belt conveyor 50 in a spaced relationship by a distance a little greater than the thickness of the disk 27 of a tray 5 and define a guide way therebetween which is wide enough to allow the peg 28 of the tray 5 to pass therethrough. The guideway thus provides the cop transporting passage 6 or 23 or the returning passage 9.

The winding units 2*a* to 2*n* are provided between the cop transporting passage 6 and the returning passage 9. Since the winding units 2*a* to 2*n* have a same construction, only the winding unit 2*a* will be described in the followings. The winding unit 2*a* includes a rotary disk 55 for transporting a cop on the cop transporting passage 6 to an unwinding position 56 and for discharging to the returning passage 9 an empty bobbin 57 after a yarn thereon has been unwound from the cop at the unwinding position 56. The disk 55 has an inclined face relative to the horizontal plane such that a portion thereof adjacent the transporting passage 6 is a little higher than a portion adjacent the returning passage 9. Guide plates 58 and 59 are disposed in a fixed spaced relationship above the rotary disk 55. The guide plates 58 and 59 define, in cooperation with the aforementioned guide plates 52, a cop entrance 60 and a cop exit 61 while they define therebetween a cop stand-by guideway 62 and a cop discharging guideway 63. The connecting point between the cop stand-by guideway 62 and the cop discharging guideway 63 provides the aforementioned unwinding position 56. A discharging lever 64 is also provided which discharges the empty bobbin after completion of such unwinding. An injection nozzle 66 is located below the tray 5 at the unwinding position 56 and may be connected to a compressed air source (not shown) by means of a duct 65. Compressed air injected from the compressed air injection nozzle 66 is jetted into the bobbin of the cop through the peg 28 of the tray 5 to blow up an end of the yarn hanging down in the bobbin externally from the top end thereof. Disposed above the cop 4 at the unwinding position 56 are a balloon breaker 67, a relay pipe 68 for introducing an end of yarn of a cop to a knotter not shown, a package not shown, another relay pipe not shown for introducing an end of a yarn of the package to the knotter, a yarn detecting device, and so on.

In FIG. 1, reference numeral 70 designates a remaining yarn detecting device, and 71 a circuit changeover device.

Operation of the system of the present invention will be described in the followings.

Figure 3:
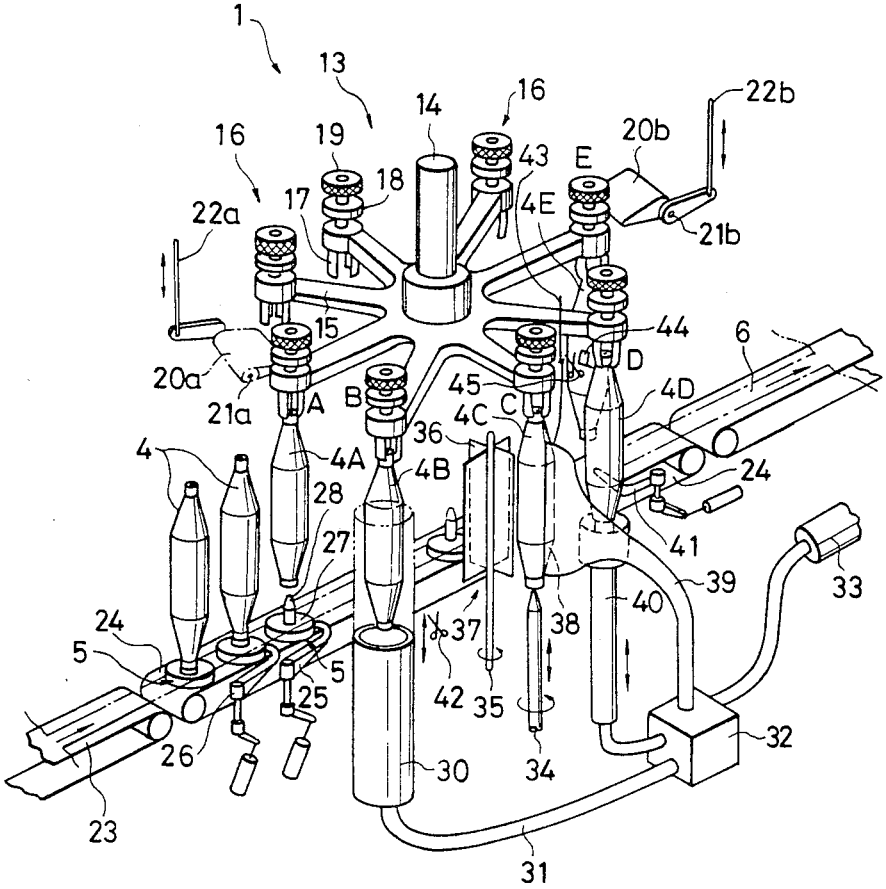
FIG. 3 is a perspective view of the cop yarn leading device.

Cops 4 which have been wound up by a fine spinning frame are fitted uprightly onto trays by a loading apparatus not shown for uprightly fitting cops onto trays and are fed to the cop yarn end readying device 1 by way of the cop inserting passage 23. An end of a yarn is led from each cop in the cop yarn end readying device 1 in a manner as described in the followings. Cops 4 which have been fed from the loading apparatus by way of the cop transporting passage 23 are transferred onto the conveyor 24 of the cop yarn end reading device 1 as seen in FIG. 3 and are then stopped by the stopper members 26, 25 to stand by thereat for a next step. The position at which a cop is stopped by the stopper 25 corresponds to the cop chucking position A.

Then, the rod 22*a* located above the cop 4*a* at the cop chucking position A is raised to cause the free end of the rocking plate 20*a* to be lowered thereby to push down the cop gripper 16 to push open the fingers 17. As the rod 22*a* is then lowered to cause the end of the rocking plate 20*a* to be raised, the fingers 17 clamp the top end of the cop 4*a* whereafter the cop gripper 16 is raised to draw up the cop 4*a* from the tray 5 as seen in FIG. 2. Then, the intermittently rotating shaft 14 is rotated an angle of 45 degrees so that the gripper 16 carries the cop 4*a* to the position B. Then, the yarn trailing end sucking pipe 30 is raised toward the cop 4B at the position B as shown by a chain line in FIG. 3 so that a trailing end of the yarn of the cop 1*b* is sucked into the yarn trailing end sucking pipe 30. Then, the intermittently rotating shaft 14 is rotated a further angle of 45 degrees to carry the cop 4 to the position C and the bobbin supporting rod 34 is raised from below the cop 4C so that it is inserted into the bottom end of the bobbin. Then, a drive roller not shown is brought into engagement with and rotates the pulley 19 so that the bobbin supporting rod 34 is rotated thereby in the direction opposite to the winding direction of a layer of a yarn of the cop. At the same time, the beater 37 is rotated to beat the surface of the yarn layer of the cop with the blades 36 thereof so that a yarn end of the cop 4C is separated from the yarn layer and is sucked into the suction opening 38 by a sucking action of the latter. Then, the intermittently rotating shaft 14 is rotated a further angle of 45 degrees to carry the cop 4 to the position D, i.e., a position above the yarn end sucking pipe 40. By this movement of the cop 4 from the position C to the position D, the end of the yarn of the cop 4D will extend between the cop 4D and the suction opening 38. Then, the yarn guide 43 is raised to engage at an end thereof with the yarn end thus extending between the cop 4D and the suction opening 38 and insert the end of the yarn into the feeler 44 which thus detects that intended leading of the end of the yarn has been effected completely. At the same time, the yarn end sucking pipe 40 is raised to engage an upper end thereof with the bottom end of the bobbin so as to effect sucking of the yarn end so that the end of the yarn cut off above the yarn end sucking pipe 40 by operation of the cutter 45 is sucked into a hollow bore of the bobbin from the top end of the bobbin by the sucking action of the yarn end sucking pipe 40 so that the yarn end will become suspended into the hollow bore of the bobbin. Meanwhile, an end part of the yarn thus cut off is sucked into the suction opening 38 and accumulated in the filter box 32. In this condition, the intermittently rotating shaft 14 is rotated a still another angle of 45 degrees to bring the cop gripper 16 to the position E which is the position after rotation of a total angle of 180 degrees from the initial position. In this position, the cop 4E is now at a position above the tray which is held stopped on the conveyor 24 by the positioning stopper 41. Then, the rod 22*b* is pulled up to cause the end of the rocking plate 20*b* to be lowered thereby to lower the cop gripper 16 and then the fingers 17 are opened to allow the cop to be dropped onto a tray 5. The stopper 41 is thereafter released so that the tray 5 which has received the cop thereon is transferred from the conveyor 24 onto the cop transporting passage 6 and is transported to the winding apparatus 3.

It is to be noted that, if a signal representative of the existence of a yarn is not issued from the feeler 44 when the yarn guide 43 is raised, then it is determined that leading of an end of a yarn has failed. In such a case, after the cop is dropped onto the tray 5 at the position E, it is fed, by a suitable means not shown, to a separately provided station where leading of a yarn end is effected.

The cop 4 which has been fed along the cop transporting passage 6 is then transferred onto the rotary disk 55 as the tray 5 on which the cop 4 is fitted is engaged with and guided by the guide plates 52, 58 and 59 of the winding unit 2*a*. The cop 4 is thus admitted into the cop stand-by guideway 62 from the cop entrance 60 and is then brought to the unwinding position 56 due to rotation and inclination of the rotary disk 55. In this way, succeeding trays 5 are successively admitted into the cop stand-by guideway 62, and when the cop stand-by guideway 62 is filled with trays 5, succeeding trays 5 after then are not admitted into the cop stand-by guideway 62 so that they will go to the next winding unit 2*b* by way of the feeding out guideway 61. In this manner, the cop stand-by guideways 62 of all of the winding units are filled one after another with trays 5 on which cops 4 are fitted uprightly, beginning with the first winding unit 2*a* and ending with the last winding unit 2*n*. Thus, if there appear spacings in any of the cop stand-by guideways 62, such spacings will be filled with trays, beginning with the first winding unit 2*a* or a winding unit nearmost to the first winding unit 2*a*. Surplus cops or trays which have not been admitted into any of the winding units 2*a*, 2*b*, . . . 2*n* are then fed out of the feeding out guideway 61 of the last winding unit 2*n* into the recirculating passage 11. Such surplus cops are then fed along the recirculating passage 11 until they are introduced into the cop transporting passage 6 at a position upstream of the first winding unit 2*a* so that they may be fed to the winding apparatus 3 again. If a cop 4 is brought to the unwinding position 56, then an end of a yarn of the cop 4 is tied with an end of another yarn of a package not shown and winding of the yarn of the cop 4 onto the package is started.

When a layer of the yarn of the cap is completely unwound to make the bobbin empty, a yarn detector not shown operates so that rotation of the package is stopped and the empty bobbin discharging lever 64 is turned to carry the tray 5 into the returning passage 12 via the cop discharging guideway 62.

If an accident such as breakage of a yarn should happen during unwinding of a cop, then piecing up of the yarn may be effected by a known means. But, if piecing up of a yarn is impossible for the cop, a predetermined number, two or three times, of yarn piecing up operations for the cop are effected whereafter the empty bobbin discharging lever 64 is rendered operative to discharge into the returning passage 9 the disunwindable cop 8 with a yarn layer remaining on the bobbin thereof. The yarn of the disunwindable cop 8 discharged into the returning passage 9 is removed or unwound therefrom by means of an disunwindable cop unwinding device not shown with the embodiment of FIG. 2 and only the empty bobbin is fed to a spinning machine. On the other hand, with the embodiment of FIG. 1, such disunwindable cops are detected by means of the remaining yarn detecting device 70. If a disunwindable cop is detected, then the changeover device 71 operates so that the cop 8 is fed to the disunwindable cop circuit 12 and then fed along the cop carrying in passage 23 to the cop yarn leading device 1 again in which leading of an end of the yarn is effected.

Empty bobbins 7 uprightly fitted on trays 5 which have been feed out into the returning passage 9 are then unloaded or removed from the trays 5 by means of an empty bobbin unloading device not shown. Then, the empty bobbins 7 are fed to a spinning machine while the empty trays are fed to the cop loading device.

As has been described hereinabove, according to the present invention, a cop transporting system for an automatic winder of the type which has a cop yarn end readying device, and a winding apparatus including a plurality of winding units for winding up yarns of cops which have been led by said cop yarn leading device, and wherein a cop carrying in passage and returning passage are provided between said cop yarn leading device and said winding apparatus, comprises a surplus cop recirculating passage provided between a last one and a first one of said plurality of winding units in contiguous relationship to said cop carrying in passage. By this construction, cops which are to be unwound at the winding units of the winding apparatus can be continuously transported to the winding units by way of the cop carrying in passage, and a plurality of cops can be held stand-by in the cop stand-by guideway of each of the winding units. If the cop stand-by guideway of a winding unit is brought into a full stock condition, then cops are filled in the cop stand-by guideway of a subsenquent next winding unit, and in this way, the cop stand-by guideways of all of the winding units become filled with cops finally. Cops which have not been admitted into any of the winding units can be brought back to the cop transporting passage of the first winding unit by way of the surplus cop recirculating passage, and therefore, the winding units can be always maintained almost in a full stock condition with the stand-by positions thereof occupied by cops, thus eliminating deterioration of the winding efficiency by disunwindable cops. Further, since a newly supplemented cop is naturally admitted into a spacing available for a cop in any of the cop stand-by guideways, it eliminates the necessity of detecting and indicating that there remain no stand-by cop and thus eliminates automatic introduction or introduction by a hand of a man of a new cop to the relevant stand-by position, thereby saving the equipment and labor.

What is claimed is:

1. A cop transporting system for transferring cops carried on trays between a spinning frame and an automatic winder of the type which has a winding apparatus including a plurality of winding units for winding up yarns of said cops, comprising: a cop transporting conveyor adjacent said winding units for transporting said cop carrying trays from said spinning frame to said winding units, said cop transporting conveyor having a first end and a second end, a returning conveyor adjacent said winding units for transporting said trays from which said cops have been removed from said winding units to said spinning frame, diversion means adjacent each of said winding units for selectively diverting said cop carrying trays transported on said transporting conveyor away from said winding units, a surplus cop recirculating conveyor communicating with said second end of said cop transporting conveyor for returning said diverted cop carrying trays to said first end of said cop transporting conveyor, said transporting conveyor and said recirculating conveyor being configured to accept said cop carrying trays at random intervals as said cop carrying trays are delivered to said conveyors.

2. A cop transporting system as claimed in claim 1, wherein each of said trays further comprises a disk having a vertical peg disposed at the center thereof for supporting a cop thereon.

3. A cop transporting system as claimed in claim 2, wherein said cop transporting conveyor, said returning conveyor and said surplus cop recirculating conveyor each further comprise a belt conveyor, and a pair of guide plates which are supported above said belt conveyor in a spaced relationship by a distance greater than the thickness of said disk of said tray, said guide plates defining a guide way therebetween, said guide way being wide enough to allow said peg of said tray to pass therethrough.

4. A cop transporting system as claimed in claim 1 or claim 2, wherein each of said winding units further comprises a cop stand-by guideway and a cop discharging guideway provided between said cop transporting conveyor and said returning conveyor.

5. A system for transferring cops carried on trays between a spinning frame and a winder having a plurality of winding units for processing said cops, comprising:

a transporting conveyor adjacent said winding units for transporting said cop carrying trays from said spinning frame to said winding units, said transporting conveyor having a first end and a second end;

diversion means adjacent each of said winding units for selectively diverting said cop carrying trays transported on said transporting conveyor away from said winding units;

a recirculating conveyor communicating with said second end of said transporting conveyor for returning said diverted cop carrying trays to said first end of said transporting conveyor;

said transporting conveyor and said recirculating conveyor being configured to accept said cop carrying trays at random intervals as said cop carrying trays are delivered to said conveyors.

* * * * *